US005355535A

United States Patent [19]

Bruder

[11] Patent Number: 5,355,535

[45] Date of Patent: Oct. 18, 1994

[54] HAT SUNGUARD DEVICE

[76] Inventor: Thomas A. Bruder, 2500 W. 87th St., Bloomington, Minn. 55431

[21] Appl. No.: 52,633

[22] Filed: Apr. 23, 1993

[51] Int. Cl.[5] ..... A42B 1/06

[52] U.S. Cl. ..... 2/172; 2/181; 2/181.4; 2/209.13

[58] Field of Search ..... 2/172, 181, 181.2, 181.4, 2/184.5, 185 R, 196, 199, 207, 209.1

[56] References Cited

U.S. PATENT DOCUMENTS

| | | | |
|---|---|---|---|
| 889,640 | 6/1908 | Sherman | 2/172 |
| 5,046,195 | 9/1991 | Koritan | 2/199 |
| 5,201,077 | 4/1993 | Dondlinger | 2/199 |
| 5,212,837 | 5/1993 | Gose | 2/199 |

FOREIGN PATENT DOCUMENTS

| | | | |
|---|---|---|---|
| 200750 | 7/1923 | United Kingdom | 2/181 |

*Primary Examiner*—Clifford D. Crowder
*Assistant Examiner*—Diana L. Biefeld
*Attorney, Agent, or Firm*—Palmatier, Sjoquist & Helget

[57] ABSTRACT

The invention relates to a hat sunguard for use with any size of expandable or fitted "baseball" style hat having an upturned inner band. The invention includes a substantially rectangular body having a pair of pockets and a centrally positioned notch along the upper portion of the body. The pockets are adapted for folding engagement to the interior of the upturned inner band on opposite sides of the interior of the hat. The notch permits the expansion of the positioning of the pockets for engagement to any size of hat. The body depends from the back of the hat protecting the back of a wearer's neck and ears from harmful waves of sunlight.

19 Claims, 1 Drawing Sheet

HAT SUNGUARD DEVICE

BACKGROUND OF THE INVENTION

The present invention relates to a hat sunguard for use by an individual to protect against sunburn. Frequently, the ears and back of the neck of an individual become sunburned during use of a "baseball" style hat. These types of hats provide limited protection from the sun by covering the top portion of a person's head, and by providing some shade to an individual's face. "Baseball" style hats as known do not provide comprehensive protection to an individual with respect to shielding the individual for harmful waves of sunlight. Standard baseball style hats, and adjustable sized baseball hats, as a result of their shape, do not provide for the easy attachment of sun shielding devices. The present invention provides flexibility to an individual, permitting the easy attachment and removal of the invention to a standard or adjustable style baseball hat.

SUMMARY OF THE INVENTION

The invention relates to a hat sunguard for use with any size of expandable or fitted "baseball" style hat having an upturned inner band. The invention includes a substantially rectangular body having a pair of pockets and a centrally positioned notch along the upper portion of the body. The pockets are adapted for folding engagement to the interior of the upturned inner band on opposite sides of the interior of the hat. The notch permits the expansion of the positioning of the pockets for engagement to any size of hat. The body depends from the back of the hat protecting the back of a wearer's neck and ears from harmful waves of sunlight.

It is a principal object of the present invention to provide a new and improved sunguard device for attachment to a baseball style hat of relatively simple and inexpensive design, construction and operation, which is safe, durable, and machine washable, and which fulfills the intended purpose of reducing sunburn without fear of injury to a person or damage to a person's hat.

It is still another object of the present invention to be easily attachable and removable from any standard and/or adjustable size type of baseball hat.

It is still another object of the present invention to protect an individual's ears and the back of the person's neck from sunburn during use of a baseball style hat.

It is still another object of the present invention to provide an individual with a flexible, convenient, and machine washable sunguard for use with the person's hat.

It is still another object of the present invention to provide an area on the body of the invention for marking of advertisements at the discretion of a manufacturer.

A feature of the present invention is a sunguard formed of light weight cotton fabric which may be used with standard and/or expandable type baseball hats.

Still another feature of the present invention is a central notch which provides flexibility with respect to use of the invention with any size of standard or expandable baseball hat.

Still another feature of the present invention is a body which may be positioned and engaged to the interior upturned band of a hat.

Still another feature of the present invention is a body having rounded corners.

Still another feature of the present invention is a pair of pockets holding tab members where one pocket is located on each of side of a notch.

Still another feature of the present invention is a resilient, substantially rectangular tab, located within each tab pocket.

Still another feature of the present invention is the engagement between the tab pockets and the inside of the upturned interior band of a hat, which attaches the hat sunguard in a position where the invention depends from back of the hat.

DETAILED SPECIFICATION OF THE PREFERRED EMBODIMENT

Figure 1:
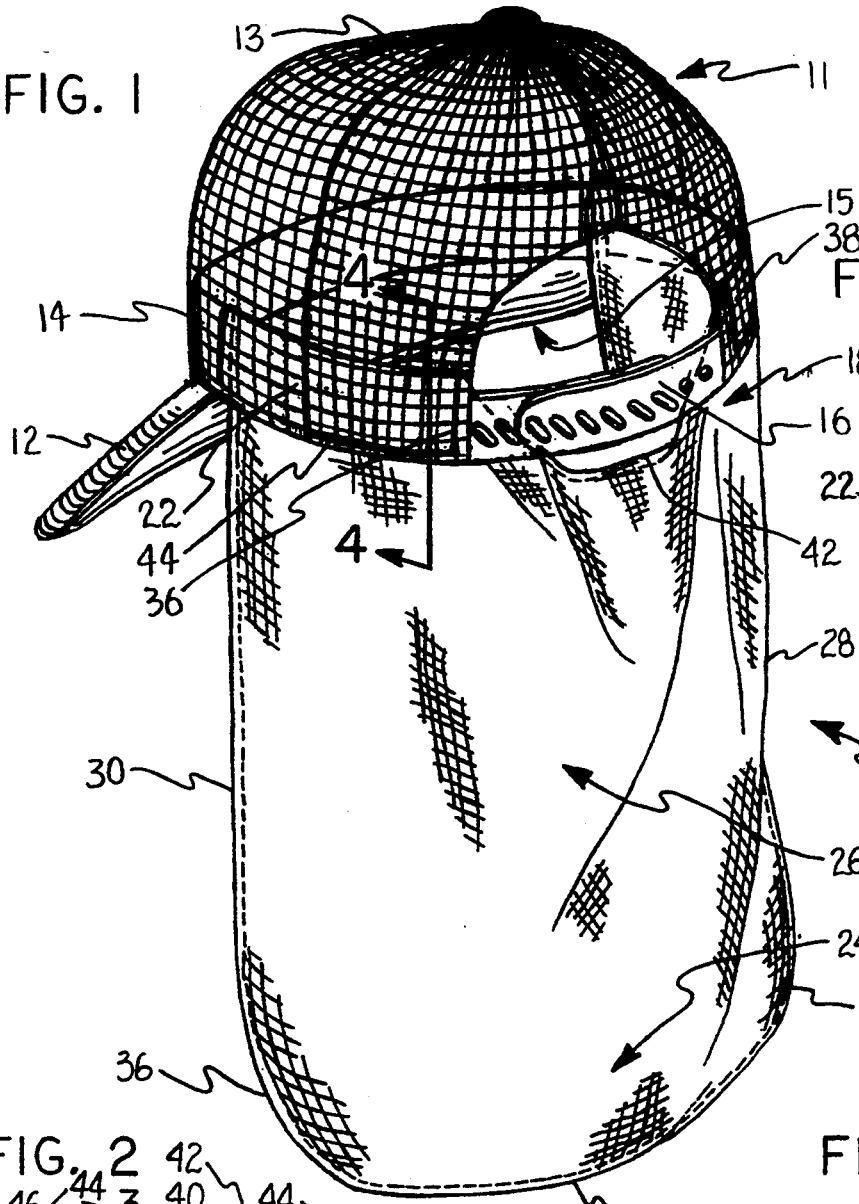
FIG. 1 is an environmental partially phantom line view of the invention.

One form of the invention is illustrated and described herein. In general, the hat sunguard is indicated by the numeral 10. The hat sunguard 10 is preferably engaged to a hat 11 having a bill 12, crown portion 13, an inner band 14, an interior 15, and an expandable member 16. These general features of a "baseball style" of hat 11 are known to individuals. It should be noted that the lower portion of the interior 15 of the hat 11 is encircled by an upturned inner band 14. It should also be noted that a "baseball style" of hat 11 may include an expandable member 16 for adjustment of the size of the hat 11 to fit the head size of an individual wearer. Generally, these hats 11 are formed of a fabric material where the crown portion 13 fits over an individual's head and the bill 12 provides some protection to an individual from sunburn. The inner band 14 is preferably folded upward within the interior 15 of the hat 11 for positioning in flush contact with the interior of the crown portion 13. Generally, the inner band 14 is not affixed to the interior of the crown portion 13. (FIG. 1)

Figure 2:
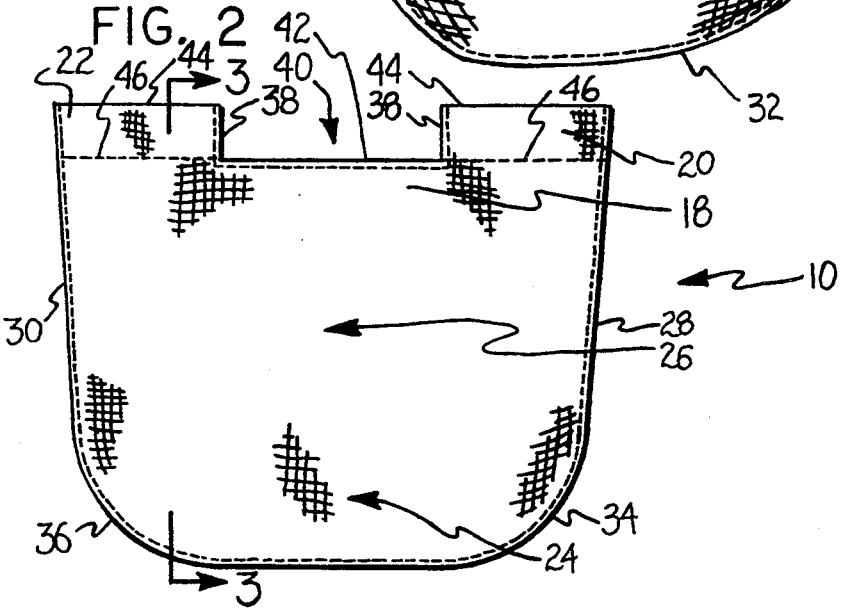
FIG. 2 is an isometric view of the invention.

The hat sunguard 10 is preferably formed of one piece construction and is positioned and engaged to the inner band 14 and portion of the interior surface of the crown 13, proximal to the inner band 14. The hand sunguard 10 may be used with either a standard fitted or expandable baseball style of hat 11 at the preference of an individual. (FIGS. 1 and 2)

The hat sunguard 10 generally includes a substantially rectangular body having an upper portion 18 having a first pocket 20 and a second pocket 22. The hat sunguard 10 also includes a lower portion 24, a central portion 26, a first edge 28, a second edge 30, a third edge 32, a first corner 34, and a second corner 36. (FIG. 2)

The hat sunguard 10 is generally formed of cloth or cotton fabric material having length and width dimensions equals to twelve inches and fourteen and one-half inches, respectively. The material and dimensions of the hat sunguard 10 may be varied substantially at the preference of an individual, provided the essential features, functions, and attributes described herein are not sacrificed. The dimensions and material of the hat sunguard 10, as indicated above, have been provided for illustrative purposes and are not intended to be limiting.

The upper portion 18 includes a first pocket 20, a second pocket 22, an interior edge 38 for each of the first and second pockets 20, 22, a notch 40 having a lower edge 42, a fourth edge 44 for each of the first and second pockets 20, 22, and a fifth edge 46 for each of the first and second pockets 20, 22. (FIG. 2)

The notch 40 is preferably centrally positioned in the upper portion 18 equal distances between the first and second edges 28 and 30. The notch 40 preferably has dimensions of length and depth equal to six inches and one and one-half inches, respectively. The notch 40 is defined by the interior edge 38 of the first pocket 20, the lower edge 42 of the notch 40, and the interior edge 38 of the second pocket 22. The notch 40 preferably has rounded corners where the lower edge 42 joins the interior edges 38 of the first and second pockets 20, 22. Preferably, the lower edge 42 of the notch 40 is formed by the stitching of a double thickness of fabric material of the hat sunguard 10. The lower edge 42 of the notch 40 is preferably parallel to the third edge 32 and extends between the interior edges 38 of the first and second pockets 20, 22. (FIG. 2)

The purpose of the notch 40 is to permit the expansion and/or contraction of the positioning of the first and second pockets 20, 22 between the upturned inner band 14 and the interior of the crown portion 13, proximal to the upturned inner band 14, during engagement of the hat sunguard 10 to the interior 15 of the hat 11. (FIGS. 1 and 2)

The first pocket 20 is defined on one side by an interior edge 38 and on the other side by the first edge 28. The first pocket 20 extends vertically between the fourth edge 44 and the fifth edge 46. The interior edge 38 of the first pocket 20 is proximal to the notch 40. (FIG. 2)

The second pocket 22 is defined on one side by the interior edge 38 and on the other side by the second edge 30. The second pocket 22 extends vertically between the fourth edge 44 and the fifth edge 46. The interior edge 38 of the second pocket 22 is proximal to the notch 40. (FIG. 2)

Each of the first and second pockets 20, 22 have length and height dimensions equal to four and one-quarter inches and one inch, respectively. Each of the first and second pockets 20, 22 are preferably rectangular in shape and are formed by folding a section of the upper portion 18 upon itself, and stitching the doubled section of the upper portion 18 defining the fourth and fifth edges 44 and 46, respectively.

Each of the first and second pockets 20, 22 has interior edges 38 proximal to the notch 40. Each of the interior edges 38 are parallel to each other and are generally perpendicular to the lower edge 42 of the notch 40 and to the fourth edges 44. Each of the interior edges 38 are also parallel to the first and second edges 28 and 30, respectively. Each of the interior edges 38 extend between the fourth edges 44 of the first and second pockets, 20, 22 and the lower edge 42 of the notch 40.

Figure 3:
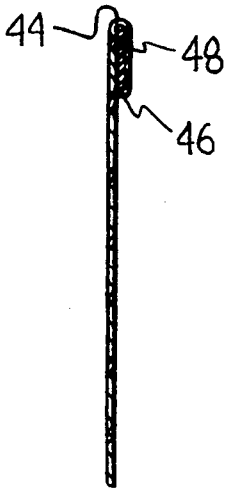
FIG. 3 is cross sectional side view of the invention taken along the line of 3—3 of FIG. 2.

Each of the first and second pockets 20, 22 has a fourth edge 44. The fourth edges 44 are preferably formed by the crease or fold resulting upon the folding of a section of the upper portion 18 upon itself, and affixation of the folded section to the upper portion 18, which defines the fifth edges 46. The creases or folds of the first and second pockets 20, 22 are then defined as the fourth edges 44. Alternatively, a piece of fabric material of equal size to the first and second pockets 20, 22 may be positioned such that affixation of the piece of fabric to the upper portion 18 defines the first and second pockets 20, 22. The alternate piece of fabric is preferably stitched to the upper portion 18 in order to define the fourth and fifth edges 44, 46, respectively. (FIGS. 2 and 3)

Each of the fourth edges 44 lie in a common plane. The fourth edges 44 are preferably parallel to the lower edge 42 of the notch 40 and the third edge 32. One of the fourth edges 44 is defined on one side by the interior edge 38 of the first pocket 20 and on the other side by the first edge 28. The other fourth edge 44 is defined on one side by the interior edge 38 of the second pocket 22 and on the other side by the second edge 30. It should be noted that in the preferred embodiment the fourth edges 44 are not stitched but are formed by the crease or fold of the fabric material upon itself during construction of the first and second pockets 20, 22. (FIGS. 2 and 3)

Each of the first and second pockets 20, 22 has a fifth edge 46. The fifth edges 46, in conjunction with the interior edges 38, the first and second edges 28, 30, and the fourth edges 44 define the rectangular shape of the first and second pockets 20, 22. Each of the fifth edges 46 traverse the upper portion 18 of the hat sunguard 10, parallel to the fourth edges 44. One of the fifth edges 46 extends between the interior edge 38 of the first pocket 20 and the first edge 28. The other fifth edge 46 extends between the interior edge 38 of the second pocket 22 and the second edge 30. Both of the fifth edges 46 are aligned in a common plane with the lower edge 42 of the notch 40. The fifth edges 46 are preferably formed by stitching of a double thickness of fabric material of the upper portion 18. The double thickness of fabric material establishes an interior for each of the first and second pockets 20, 22. (FIGS. 2 and 3)

Figure 4:
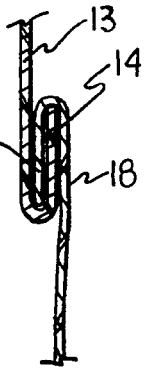
FIG. 4 is a partial cross sectional side view of the invention take along the line of 4—4 of FIG. 1.

The interior of each of each of the first and second pockets 20, 22 holds a tab member 48. Each tab member 48 is preferably formed of plastic material having dimensions of length and height equal to four inches and three-quarters inches, respectively. Each tab member 48 is preferably flexibly resilient and durable retaining its shape upon exposure to prolonged use within the first and second pockets 20, 22. The tab members 48 are retained inside the first and second pockets 20, 22 by stitching of the first or second edges 28, 30, the interior edges 38, and the fifth edges 46. Alternately, each tab member 48 may be directly stitched to the interior of the first and second pockets 20, 22. Each tab member 48 may be positioned inside one of the first or second pockets 20, 22 during the folding of the upper portion 18, or a tab member 48 may be slid into the first or second pockets 20, 22 before the completion of the stitching of one of the interior edges 38, first and second edges 28, 30, or the fifth edges 46. (FIGS. 2, 3 and 4)

The purpose of each of the first and second pockets 20, 22 is to engage the inner band 14 and the crown portion 13, on opposite sides of the interior 15 of the hat 11. The first and second pockets 20, 22 permit the hat sunguard 10 to be attached to the back of the hat 11, which is proximal to the expandable member 16. The hat sunguard 10 depends from the back of the hat 11 following attachment of the first and second pockets 20, 22. The hat sunguard 10 covers the back of a wearer's neck and ears providing protection from sunburn. The first and second pockets 20, 22, which extend from the upper portion 18, provide the means for attachment of the hat sunguard 10 to the hat 11. (FIGS. 1 and 4)

The purpose of each of the tab members 48 is to provide a resilient feature to the first and second pockets 20, 22 improving the ease of engagement to the inner band 14 of the hat 11. The tab members 48 also improve the engagement between the upper portion 18 and the inner band 14, thereby reducing the involuntary separation of the hat sunguard 10 from the hat 11. The resilient feature of the tab members 48 prevents bunching of the first and second pockets 20, 22 thereby improving the comfort to a wearer following engagement to the inner band 14. (FIGS. 1, 3 and 4)

The lower portion 24 of the sunguard 10 is defined by the third edge 32. During use, the lower portion 24 preferably protects and individual's ears and the back of a person's neck from sunburn. The lower portion 24 of the hat sunguard 10 is preferably substantially rectangular in shape. (FIGS. 1 and 2)

The central portion 26 of the hat sunguard is located equal distances between the upper portion 18 and the lower portion 24. The central portion 26 is laterally defined by the first and second edges 28 and 30. A purpose of the central portion 26 is to provide a manufacturer or individual with an area for the marking of advertising or logos. FIGS. 1 and 2)

The first edge 28 depends from the fourth edge 44 of the first pocket 20 and extends to the first corner section 34. The first edge 20 is preferably straight and is parallel to the second edge 30 and to the interior edges 38. The first edge 28 is preferably ten inches in length and is formed by the stitching of a double thickness of folded fabric material of the hat sunguard 10. The length of the first edge 28 may be varied substantially at the preference of an individual so long as the length of the first edge 28 is equal to the length of the second edge 30. (FIGS. 1 and 2)

The second edge 30 depends from the fourth edge 44 of the second pocket 22 and extends to the second corner section 36. The second edge 30 is preferably straight and is parallel to the first edge 28 and to the interior edges 38. The second edge 30 is preferably ten inches in length and is formed by the stitching of a double thickness of folded fabric material of the hat sunguard 10. The length of the second edge 30 may be varied substantially at the preference of an individual so long as the length of the second edge 30 is equal to the length of the first edge 28. (FIGS. 1 and 2)

The third edge 32 is perpendicular to the first and second edges 28, 30 and is parallel to the fourth edges 44, fifth edges 46, and lower edge 42 of the notch 40. The third edge 32 preferably has a length dimension equal to six inches. The third edge 32 is preferably positioned equal distances between the first and second edges 28, 30 and is generally vertically aligned below the notch 40 of the upper portion 18. The third edge 32 defines the lower portion 24 of the hat sunguard 10 and extends between, and is defined by, the first and second corner sections 34 and 36, respectively. The third edge 32 is formed by stitching of a double thickness of folded fabric material of the hat sunguard 10. The length of the third edge 32 may be varied substantially at the discretion of an individual. (FIGS. 1 and 2)

The first corner section 34 extends between the first edge 28 and the third edge 32. The first corner section 34 has an arc having a five inch radius between the first and third edges 28 and 32, respectively. The first corner section 34 is preferably formed by stitching of a double thickness of folded fabric material of the hat sunguard 10. The first corner section 34 assists in preventing the bunching or juxtapositioning of the hat sunguard 10 during use by an individual. The first corner section 34 provides a rounded corner which does not become entangled with, or catch upon, collars and/or other items of clothing worn by an individual. (FIGS. 1 and 2)

The second corner section 36 extends between the second edge 30 and the third edge 32. The second corner section 36 has an arc having a five inch radius between the second and third edges 30 and 32, respectively. The second corner section 36 is preferably formed by stitching of a double thickness of folded fabric material of the hat sunguard 10. The second corner section 36 assists in preventing the bunching or juxtapositioning of the hat sunguard 10 during use by an individual. The second corner section 36 provides a rounded corner section which does not become entangled with, or catch upon, collars and/or other items of clothing worn by an individual. (FIGS. 1 and 2)

During use of the hat sunguard 10, the first and second pockets 20, 22 are positioned on opposite sides of the interior 15 of the hat 11 between the upturned inner band and the crown portion 13 proximal to the upturned inner band 14. The application of the hat 11 upon an individual's head securely pinches the first and second pockets 20, 22 between the upturned inner band 14, and the crown portion 13 proximal to the upturned inner band 14, affixing the hat sunguard 10 to the hat 11. The first and second pockets 20, 22 are folded downward for engagement to the hat 11 between the upturned inner band 14 and the crown portion 13. Separation of the hat sunguard 10 from the hat 11 is difficult following placement of the hat 11 upon an individual's head. The expandable member 16 preferably insures that the hat 11 is snugly sized to fit a particularly wearer. The upper portion 18 of the hat sunguard 10 below the fifth edges 46 is then in contact with an individual's head during use. The notch 40 provides flexibility to an individual by permitting the contracted or expanded positioning of the first and second pockets 20, 22 to the interior of the upturned inner band 14. The resilient tab members 48 within each of the first and second pockets 20, 22 improves the engagement of the hat sunguard 10 to the upturned inner band 14, reducing involuntary separation therefrom. The upper portion 18, central portion 26, and lower portion 24 are then preferably positioned to cover the back of an individual's neck and the person's ears to minimize, if not eliminate, sunburn resulting from the harmful waves of sunlight exposed to an individual during outdoor activities. (FIGS. 1 and 4)

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A hat with a detachable hat sunguard device comprising:

(a) a baseball-style hat having a bill, and a dome having an interior, an upturned inner band, a back having coupling adjustable members, and interior opposite sides; and (b) a hat sunguard having a substantially rectangular body formed of a fabric material, said body having an upper portion and a lower portion, said upper portion having a centrally positioned notch having a lower edge defining a pair of pockets having interior edges proximal to said notch, said body further having a first edge depending from one of said pockets opposite to said interior edge of said one pocket, and a second edge depending from said other pocket opposite to said interior edge of said one pocket, said body further having a third edge perpendicular to said first and second edges proximal to said lower portion, said body further having a pair of rounded corners where one of said rounded corners extends between said first edge and said third edge and said other rounded corner extends between said second edge and said third edge, said body further having a pair of resilient tab members where one of said tab members is positioned inside each of said pockets and each of said pockets is releasably and foldably engaged over said upturned inner band on opposite sides of said interior of said hat where said pockets are frictionally pinched between said interior opposite sides and said upturned inner band releasably and adjustably attaching said hat sunguard to said hat where said body depends from said back of said hat.

2. The device according to claim 1, wherein said first edge and said second edge are parallel to each other.

3. The device according to claim 1, each of said pockets further comprising:

(a) a rectangular interior holding one of said tab members;

(b) a fourth edge aligned in a common plane between each of said pockets, where each of said interior edges is perpendicular to each of said fourth edges; and (c) a fifth edge traversing said upper portion of said body parallel to said fourth edge where one of said fifth edges extends between said interior edge of said pocket and said first edge and said other fifth edge extends between said interior edge of said other pocket and said second edge, said fifth edges being aligned in a common plane with said lower edge of said notch.

4. The device according to claim 3, wherein said fourth edges are formed by folding of said body to define said pockets and said interior edges, and said fifth edges are formed by stitching.

5. The device according to claim 4, wherein said lower edge of said notch is parallel to said third edge and extends between said interior edges of said pockets.

6. The device according to claim 3, wherein said fourth edges are parallel to said third edge and are parallel to said lower edge of said notch.

7. The device according to claim 3, wherein said interior edges extend between said fourth edges of said pockets and said lower edge of said notch.

8. The device according to claim 7, wherein said interior edges have rounded corners proximal to said lower edge of said notch.

9. The device according to claim 3, wherein one of said fourth edges extends between said second edge and said interior edge of one of said pockets, and said other fourth edge extends between said first edge and said interior edge of said other pocket.

10. The device according to claim 3, wherein one of said pockets is defined laterally by one of said interior edges and said first edge, and is vertically defined by said fourth edge and said fifth edge.

11. The device according to claim 3, wherein one of said pockets is defined laterally by one of said interior edges and said second edge, and is defined vertically by said fourth edge and said fifth edge.

12. The device according to claim 1, wherein each of said pockets has an equal length and said notch has a length equal to the length of one of said pockets.

13. The device according to claim 1, wherein said interior edges are parallel to each other and are parallel to said first edge and said second edge.

14. The device according to claim 1, wherein said first, second, and third edges, said interior edges, said lower edge of said notch, and said rounded corners are defined by stitching a double thickness of fabric material.

15. The device according to claim 1, wherein said tab members are formed of plastic material.

16. The device according to claim 1, wherein said tab members are affixed to said pockets by stitching.

17. A combination hat and hat sunguard device comprising:

(a) a baseball-style hat having a bill, and a dome having an interior, and upturned inner band, a back having coupling adjustable members, and interior opposite sides; and (b) a hat sunguard having a substantially rectangular body formed of a fabric material, said body having an upper portion and a lower portion, said upper portion having a centrally positioned notch having a lower edge defining a pair of pockets having interior edges proximal to said notch, said body further having a first edge depending from one of said pockets opposite to said interior edge of said one pocket, and a second edge depending from said other pocket opposite to said interior edge of said other pocket, said body further having a third edge perpendicular to said first and second edges proximal to said lower portion, said body further having a pair of rounded corners where one of said rounded corners extends between said first edge and said third edge and said other rounded corner extends between said second edge and said third edge, said body further having a pair of resilient tab members where one of said tab members is positioned inside each of said pockets, each of said pockets comprising:

(i) a rectangular interior holding one of said resilient tab members;

(ii) a fourth edge aligned in a common plane between each of said pockets where each of said interior edges is perpendicular to each of said fourth edges; and (iii) a fifth edge traversing said upper portion of said body parallel to said fourth edge where one of said fifth edges extends between said interior edge of said one pocket and said first edge, and said other fifth edge extends between said interior edge of said other pocket and said second edge, where said fifth edges are aligned in a common plane with said lower edge of said notch, where each of said pockets is releasably and foldably engaged over said upturned inner band on opposite sides of said interior of said hat, where said pockets are frictionally pinched between said interior opposite sides and said upturned inner band releasably and adjustably attaching said hat sunguard to said hat where said body depends from said back of said hat.

18. A combination hat and hat sunguard device comprising:

(a) a baseball-style hat having a bill and a dome having an interior, and upturned inner band, a back having coupling adjustable members, and interior opposite sides; and (b) a hat sunguard having a substantially rectangular body formed of a fabric material, said body having an upper portion and a lower portion, said upper portion having a centrally positioned notch having a lower edge defining a pair of pockets having interior edges proximal to said notch, said body further having a first edge depending from one of said pockets opposite to said interior edge of said one pocket, and a second edge depending from said other pocket opposite to said interior edge of said other pocket, said body further having a third edge perpendicular to said first and second edges proximal to said lower portion, said body further having a pair of rounded corners where one of said rounded corners extends between said first edge and said third edge and said other rounded corner extends between said second edge and said third edge, said body further having a pair of resilient tab members where one of said tab members is positioned inside each of said pockets, each of said pockets comprising:

(i) a rectangular interior holding one of said resilient tab members;

(ii) a fourth edge aligned in a common plane between each of said pockets where each of said interior edges is perpendicular to each of said fourth edges; and (iii) a fifth edge traversing said upper portion of said body parallel to said fourth edge where one of said fifth edges extends between said interior edge of said one pocket and said first edge, and said other fifth edge extends between said interior edge of said other pocket and said second edge, where said fifth edges are aligned in a common plane with said lower edge of said notch, said fourth edges being formed by folding of said body to define said pockets and said interior edges, said fifth edges being formed by stitching, where each of said pockets is releasably and foldably engaged over said upturned inner band on opposite sides of said interior of said hat where said pockets are frictionally pinched between said interior opposite sides and said upturned inner band releasably and adjustably attaching said hat sunguard to said hat where said body depends from said back of said hat.

19. A combination hat and hat sunguard device comprising:

(a) a baseball-style hat having a bill and a dome having an interior, and upturned inner band, a back having coupling adjustable members and interior opposite sides; and (b) a hat sunguard having a substantially rectangular body formed of a fabric material, said body having an upper portion and a lower portion, said upper portion having a centrally positioned notch having a lower edge defining a pair of pockets having interior edges proximal to said notch, each of said pockets having an equal length and said notch having a length equal to the length of one of said pockets, said interior edges having rounded corners proximal to said lower edge of said notch, said body further having a first edge depending from one of said pockets opposite to said interior edge of said one pocket, and a second edge depending from said other pocket opposite to said interior edge of said other pocket, said first edge and said second edge being parallel to each other, said interior edges being parallel to each other and parallel to said first edge and said second edge, said body further having a third edge perpendicular to said first and second edges proximal to said lower portion, said lower edge of said notch being parallel to said third edge and extending between said interior edges of said pockets, said body further having a pair of rounded corners where one of said rounded corners extends between said first edge and said third edge and said other rounded corner extends between said second edge and said third edge, said body further having a pair of resilient tab members where one of said tab members is positioned inside each of said pockets, each of said pockets comprising:

(i) a rectangular interior holding one of said resilient tabs members;

(ii) a fourth edge aligned in a common plane between each of said pockets where each of said interior edges is perpendicular to each of said fourth edges; and (iii) a fifth edge traversing said upper portion of said body parallel to said fourth edges where one of said fifth edges extends between said interior edge of said one pocket and said first edge, and said other fifth edge extends between said interior edge of said other pocket and said second edge, where said fifth edges are aligned in a common plane with said lower edge of said notch, said fourth edges being formed by folding of said body to define said pockets and said interior edges, said fifth edges being formed by stitching, said fourth edges being parallel to said third edge and to said lower edge of said notch, said interior edges extending between said fourth edges of said pockets and said lower edge of said notch, one of said fourth edges extending between said second edge and said interior edge of one of said pockets, and said other fourth edge extending between said first edge and said interior edge of said other pocket, one of said pockets being defined laterally by one of said interior edges and said first edge, and being vertically defined by said fourth edge and said fifth edge, the other of said pockets being defined laterally by one of said interior edges and said second edge, and being defined vertically by said fourth edge and said fifth edge, where each of said pockets is releasably and foldably engaged over said upturned inner band on opposite sides of said interior of said hat where said pockets are frictionally pinched between said interior opposite sides and said upturned inner band releasably and adjustably attaching said hat sunguard device to said hat where an individual's head engages said upper portion of said body below said pockets frictionally pinching said upper portion of said body below said pockets against said upturned inner band which further frictionally pinches said pockets having said tab members between said interior opposite sides and said upturned inner band, whereby said body depends from said back of said hat.

* * * * *